US010258134B2

(12) United States Patent
Davis

(10) Patent No.: US 10,258,134 B2
(45) Date of Patent: Apr. 16, 2019

(54) COMB AND A PROTECTIVE GLOVE FOR THERMAL PROTECTION THAT EMPLOYS THE COMB

(71) Applicant: Steven Don Davis, Dallas, TX (US)

(72) Inventor: Steven Don Davis, Dallas, TX (US)

(73) Assignee: Iron Armour, LLC, Dallas, TX (US)

( * ) Notice: Subject to any disclaimer, the term of this patent is extended or adjusted under 35 U.S.C. 154(b) by 386 days.

(21) Appl. No.: 14/930,320

(22) Filed: Nov. 2, 2015

(65) Prior Publication Data

US 2017/0119125 A1 May 4, 2017

(51) Int. Cl.

| | |
|---|---|
| ***A45D 24/14*** | (2006.01) |
| ***A41D 13/08*** | (2006.01) |
| *A41D 19/015* | (2006.01) |
| *A45D 24/04* | (2006.01) |
| *A45D 24/00* | (2006.01) |

(52) U.S. Cl.

CPC ..... *A45D 24/14* (2013.01); *A41D 13/081* (2013.01); *A41D 19/01529* (2013.01); *A45D 24/04* (2013.01); *A45D 2024/002* (2013.01)

(58) Field of Classification Search

CPC ..... A45D 24/04; A45D 24/10; A45D 24/14; A45D 24/38; A45D 19/008; A45D 2019/0091; A46B 5/04; A41D 13/0087; A41D 2600/20

USPC ..... 2/160, 163, 16, 21, 159, 161.6; 119/625, 119/632, 600, 611, 612, 664, 618, 652; 15/105, 227, 202; 30/291, 298, 323; 172/320

See application file for complete search history.

(56) References Cited

U.S. PATENT DOCUMENTS

| | | | | |
|---|---|---|---|---|
| 1,486,006 A | | 3/1924 | Blom | |
| 2,041,262 A | | 5/1936 | Ness | |
| 2,199,282 A | * | 4/1940 | Condron | A45D 24/14 132/149 |
| 2,411,252 A | | 11/1946 | Finman | |
| 2,467,975 A | * | 4/1949 | Hollen | A45D 2/42 132/149 |
| 2,526,128 A | | 10/1950 | Grant | |
| 2,568,898 A | | 9/1951 | Phillips et al. | |
| 2,608,975 A | | 9/1952 | Shannon | |
| 2,821,203 A | | 1/1958 | Kesterson et al. | |
| 2,920,334 A | * | 1/1960 | Keller | A45D 24/04 15/176.1 |
| 3,057,367 A | | 10/1962 | Langley | |
| 3,500,477 A | | 3/1970 | Meszaros | |
| 3,608,565 A | | 9/1971 | Ensign | |
| 3,928,871 A | | 12/1975 | Wall | |
| 3,960,155 A | | 6/1976 | Wall | |

(Continued)

FOREIGN PATENT DOCUMENTS

KR 20100118298 * 11/2010

OTHER PUBLICATIONS

Machine Translation of Young.*

(Continued)

*Primary Examiner* — Tatiana Nobrega
*Assistant Examiner* — Brianne Kalach

(57) ABSTRACT

A comb and a thermal protective glove are provided herein. In one embodiment, the comb includes: (1) a base having a top side and a bottom side, (2) a longitudinal row of teeth on the top side of the base and (3) an attacher having a coupling end connected to the bottom side of the base.

13 Claims, 3 Drawing Sheets

(56) References Cited

U.S. PATENT DOCUMENTS

| | | | | |
|---|---|---|---|---|
| 4,620,374 | A | 11/1986 | Patterson | |
| 4,751,747 | A | 6/1988 | Banks et al. | |
| 4,766,914 | A | 8/1988 | Briggs | |
| 5,564,154 | A | 10/1996 | Cohn, III | |
| 5,644,796 | A * | 7/1997 | Laughlin | A41D 19/00 2/161.6 |
| 5,720,048 | A | 2/1998 | Perez | |
| 6,189,150 | B1 | 2/2001 | Jones-Roberson | |
| 6,206,010 | B1 | 3/2001 | Malki | |
| 6,260,203 | B1 | 7/2001 | Battle | |
| D524,489 | S | 7/2006 | Scott | |
| 7,346,955 | B2 | 3/2008 | De Laforcade | |
| 7,401,612 | B2 | 7/2008 | De Laforcade | |
| 2003/0079273 | A1 | 5/2003 | Genkins | |
| 2004/0182408 | A1 | 9/2004 | De Laforcade | |
| 2004/0187182 | A1 | 9/2004 | Carraway | |
| 2004/0261810 | A1 | 12/2004 | Gifford | |
| 2006/0048259 | A1 | 3/2006 | Keppler et al. | |
| 2006/0090771 | A1 | 3/2006 | Ramet | |
| 2006/0218696 | A1 | 10/2006 | Billups | |
| 2006/0230487 | A1 | 10/2006 | Salomon | |
| 2006/0253952 | A1 | 11/2006 | Caudillo | |
| 2006/0272116 | A1 | 12/2006 | Thompson | |
| 2007/0226874 | A1 | 10/2007 | Cain | |
| 2008/0313788 | A1 | 12/2008 | Yan | |
| 2009/0145452 | A1 | 6/2009 | Anderson et al. | |
| 2016/0324289 | A1 * | 11/2016 | Dixon | A45D 19/0008 |

OTHER PUBLICATIONS http://www.hai-elite.com/NEWHAIELITE/gloves.html, 2009, 1 page.
http://shop.ginalli.com/main.sc, 2009, 1 page.
http://www.maxiusbeauty.com/Tools.aspx, 2009, 1 page.

* cited by examiner

COMB AND A PROTECTIVE GLOVE FOR THERMAL PROTECTION THAT EMPLOYS THE COMB

TECHNICAL FIELD

This application is directed, in general, to a comb and, more specifically, a comb used with a hairstylist's glove.

BACKGROUND

Hair stylists provide many services to their customers including cutting, coloring and styling. Often while styling, a client's hair can become hot due to the use of styling tools, such as, blow dryers and hair irons including flat irons and curling irons. Straightening a customer's hair is another service provided by hairstylist that causes a customer's hair to become hot.

There are several different straightening processes that may be used to provide varying degrees of semi-permanent or permanent straight hair for a client. Japanese hair straightening or Brazilian hair straightening are examples of different processes that may be used to straighten a client's hair. Typically, each of these straightening processes includes applying chemicals to the hair and using a flat iron on the hair. A hairstylist may use the flat iron for multiple hours on a client's hair during the straightening process. As such, a client's hair can become sufficiently heated to burn the hands or hand of the hairstylist.

SUMMARY

In one aspect, the disclosure provides a comb. In one embodiment, the comb includes: (1) a base having a top side and a bottom side, (2) a longitudinal row of teeth on the top side of the base and (3) an attacher having a coupling end connected to the bottom side of the base.

In another aspect, another embodiment of a comb is disclosed. In this embodiment, the comb includes: (1) a base having a top side and a bottom side, (2) a longitudinal row of teeth along the top side of the base from a first end of the base to a second end of the base, (3) an attacher having a coupling end connected to the bottom side of the base at the second end thereof, and a free end that is unattached to the base, (4) a curved structure attached to the bottom of the base that extends downward away from the longitudinal row of teeth and (5) an appendicle coupled to the second end of the base.

In still another aspect, the disclosure provides a thermal protective glove. In one embodiment, the protective glove includes: (1) a palm and (2) a finger, extending from the palm, including a mounting sleeve located along a length thereof, wherein the finger and the palm are constructed of a heat resistant material.

BRIEF DESCRIPTION

Reference is now made to the following descriptions taken in conjunction with the accompanying drawings, in which.

DETAILED DESCRIPTION

In addition to employing a flat iron or another heating device, a hairstylist often employs a comb during a straightening process and in other styling procedures. It is realized herein that coordinating the heating device, the comb and the hot hair without getting burned can be challenging for a hair stylist. It is also realized herein the advantage of employing a comb with a protective glove to protect a hairstylist from hot hair and still be able to straighten/style the hair.

Accordingly, the disclosure provides a comb that a user (e.g., a hairstylist) can use in, for example, a hair straightening procedure. In one embodiment, the comb is adapted to be connected to a thermal protective glove to provide protection from heated or hot hair (i.e., protect against a burn from the hot hair) and allow styling with the comb. In some embodiments, the protective glove allows a hairstylist to comb through hot hair using the comb and fingers that are protected by heat resistant material. The comb is uniquely designed to fit along the length of a hairstylist's finger and to attach to a finger of a protective glove. In one embodiment, the protective glove includes mounting sleeves wherein the disclosed comb can be removably coupled.

The disclosed protective glove may be configured to be worn on either hand and configured to protect two different fingers of a hand. In other words, in some embodiments the same glove may be constructed such that the hairstylist can use the glove to protect, for example, the index and middle finger or the middle finger and the ring finger. In some embodiments, greater than two fingers may be protected from heated hair. For example, all of the fingers including the thumb may have at least some thermal protection. The mounting sleeves can be located along a side or sides of a single finger or multiple fingers of the protective glove.

Figure 1:
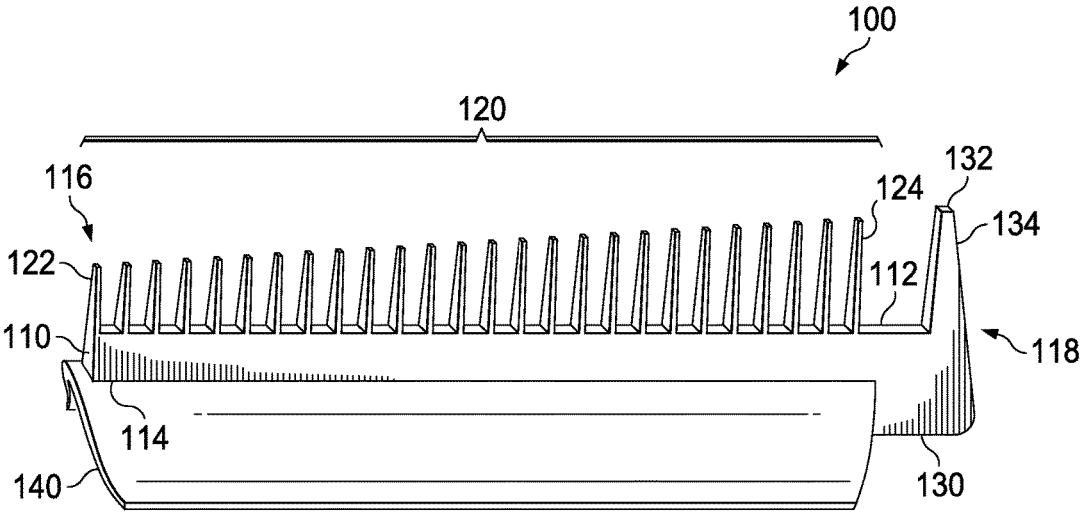
FIG. 1 illustrates a side view of an embodiment of a comb constructed according to the principles of the disclosure.

FIG. 1 illustrates a side view of an embodiment of a comb 100 constructed according to the principles of the disclosure. The comb 100 can be constructed of a synthetic resin or plastic. In some embodiments, the comb 100 is constructed of a thermoplastic. In one embodiment, the comb 100 is constructed of an Acetal resin. In other embodiments, the comb 100 can be constructed of other materials such as, carbon, wood, and metals including stainless steel and aluminum.

The comb 110 is sized to fit between the web of a finger to the tip of a finger of a user. In some embodiments, the comb 100 has a length between two and three quarters of an inch to three and a half inches. In one embodiment, the comb 100 has a length less than or equal to three inches. The comb 100 includes a base 110, a longitudinal row of teeth 120, an appendicle 130 and a curved structure 140. The comb 100 also includes an attacher 150 that is not visible from the side view of FIG. 1.

The base 110 has a top side 112 and a bottom side 114. The row of teeth 120 are on the top side 112 of the base 110 and extend therefrom. The base 110 has a width that corresponds to a width of a base of the teeth in the row of teeth 120. As noted in FIG. 1, the base 110 has a first end 116 and a second end 118.

The row of teeth 120 is located along a length of the base 110 on the top side 112. The row of teeth 120 includes multiple teeth from the first end 116 to the second end 118 of the base 110. A first tooth 122 at the first end 116 and a last tooth 124 at the second end 118 are identified in FIG. 1. In some embodiments, the teeth of the row of teeth 120 have multiple heights. In the illustrated embodiment, the heights of the multiple teeth linearly increase from the first tooth 122 to the last tooth 124. In one embodiment, the teeth in the row of teeth 120 are separated by an equal distance (including a substantially equal distance). The comb 100 can have a single row of teeth or can have multiple rows. The spacing between each tooth may vary within each of the rows. In some embodiments, a maximum height of a tooth of the row of teeth 120 is less than or equal to one half of an inch.

The appendicle 130 is attached to the base 110 at the second end 118. The appendicle 130 includes a pick 132 that extends in the same direction as the teeth of the row of teeth 120. The pick 132 is separated from the last tooth 124 of the row of teeth 120 by a gap that is sufficient to allow a hairstylist to use the pick 132 to partition strands of hair of a client. The width of the gap is greater than the distance between the teeth of the row of teeth 120. In one embodiment, the width of the gap is a quarter of an inch or approximately a quarter of an inch. The pick 132 has a tapered side 134 that is opposite the row of teeth 120 and tapers inward from the base of the appendicle 130 to the top of the pick 132. The tapered side 134 allows easier movement over a client's head compared to a straight side. In one embodiment, the height of the pick 132 is aligned with the increasing heights of the row of teeth 120. As such, the pick 132 has a height greater than a height of the last tooth 124.

The curved structure 140 is attached to the base 110 and extends downward away from the row of teeth 120. A cross section of the curved structure 140 perpendicular to a length of the base 110 is an arch with flared ends. The cross section of the curved section 140 can be seen more easily in FIG. 3. The cross section shape of the curved section 140 provides a universal fit for fingers, stability and a resting place for a thumb or another finger when the comb 100 is attached to a protective glove. As illustrated in FIG. 1, the length of the curved structure 140 extends past the first end 116 of the base 110.

Figure 2:
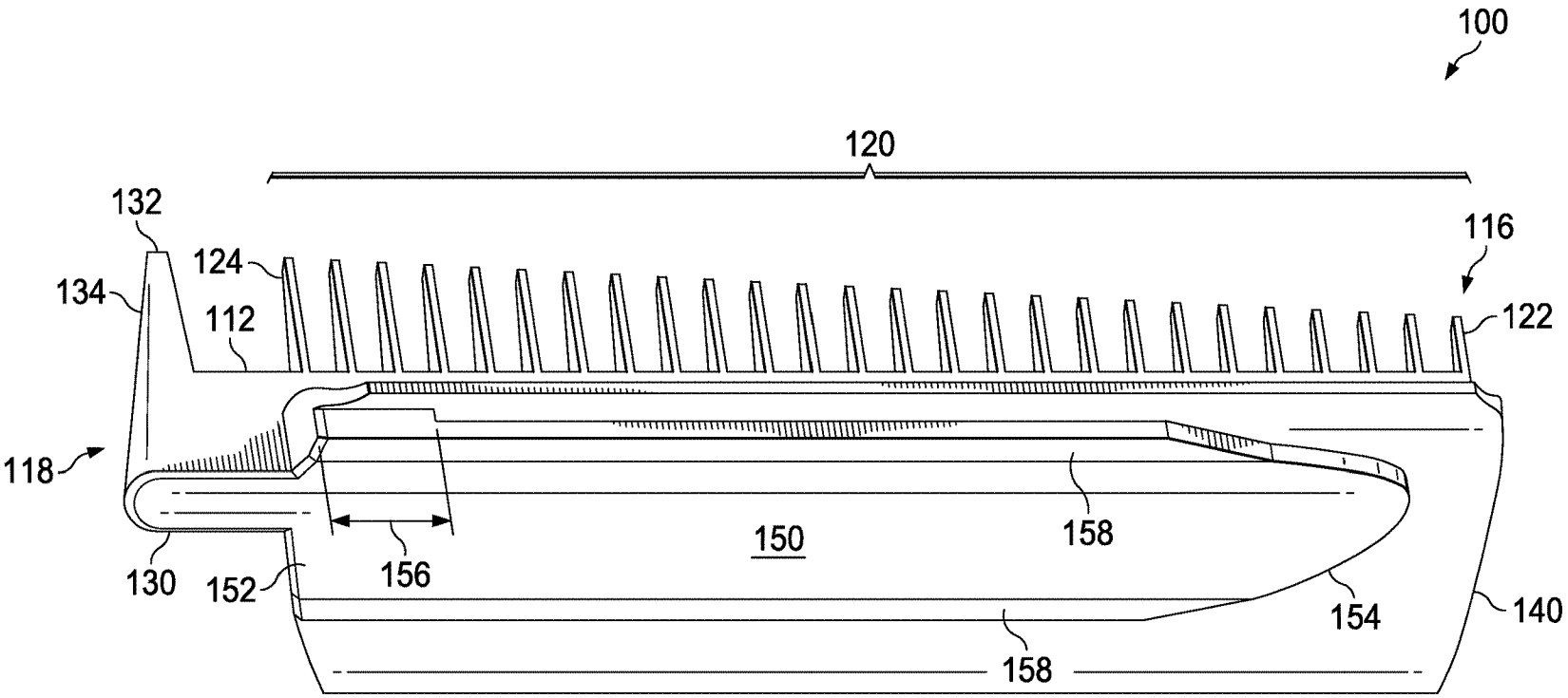
FIG. 2 illustrates a bottom perspective view of the comb illustrated in FIG. 1.

FIG. 2 illustrates a bottom perspective view of the comb 100 illustrated in FIG. 1. From this view, the attacher 150 is visible. The attacher 150 has a coupling end 152 connected to the bottom side 114 of the base 110 at an attachment area 156. In one embodiment, the attachment area 156 is the width of the attacher 150 and is about half an inch long along the length of the attacher 150. The attacher 150 also includes a free end 154 that is unattached to the base 110, and stabilized sides 158.

The attacher 150 extends along a length of the base 110. In one embodiment, the attacher 150 has a length that is less than the length of the row of teeth 120. In some embodiments, the length and width of the attacher 150 correspond to the length of a mounting sleeve on a finger of a protective glove.

The free end 154 of the attacher 150 is tapered on two sides to form a rounded end. This tapered shape allows the attacher 150 to more easily slide into the mounting sleeve. In the illustrated embodiment, the free end 154 is tongue-shaped. A cross section of the attacher 150 perpendicular to the length of the base 110 has a curved shape. In one embodiment, the curve shape corresponds to the side of a finger of a user.

The stabilized sides 158 extend along a portion of the length of the attacher 150. In the illustrated embodiment, the stabilized sides 158 extend from the attachment area 156 to the tapered sides of the attacher 150. The stabilized sides 158 provide stability and support for the comb 100 around a finger when attached to a protective glove, such as in a mounting sleeve discussed below.

Figure 3:
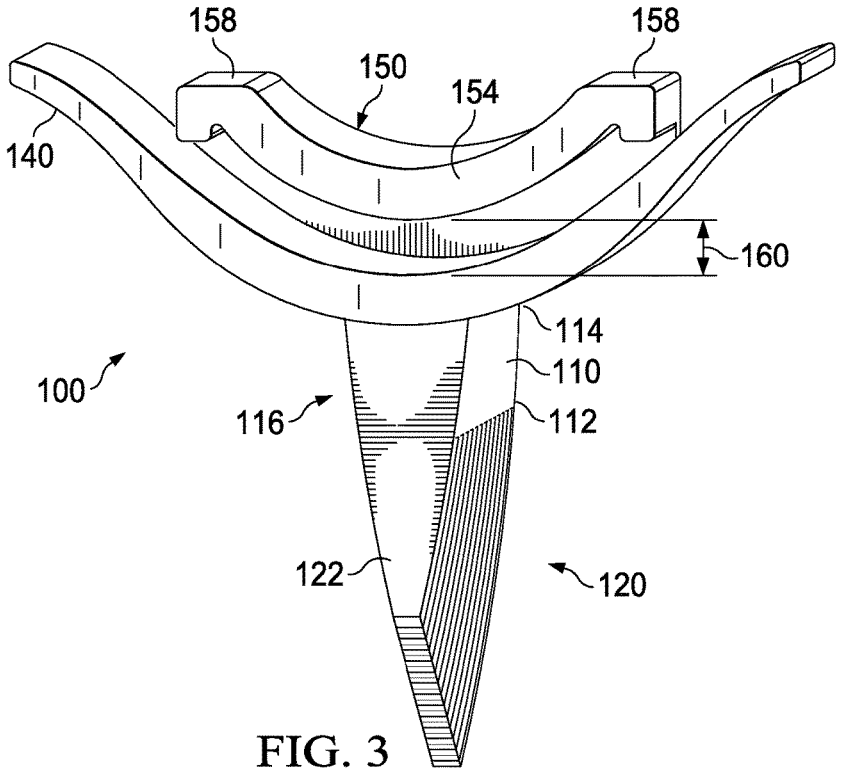
FIG. 3 illustrates an end perspective view of the comb illustrated in FIG. 1.

FIG. 3 illustrates an end view of the comb 100 illustrated in FIG. 1. The end view is from the first end 116 of the base 110. A gap 160 is indicated between the attacher 150 and the curved structure 140 at the free end 154 of the attacher 150. The gap 160 can be sized to correspond to the mounting sleeve of the protective glove. In one embodiment, the gap 160 is approximate the thickness of the mounting sleeve to allow the comb 100 to slide into the mounting sleeve and remain secure until removed by a user.

Figure 4:
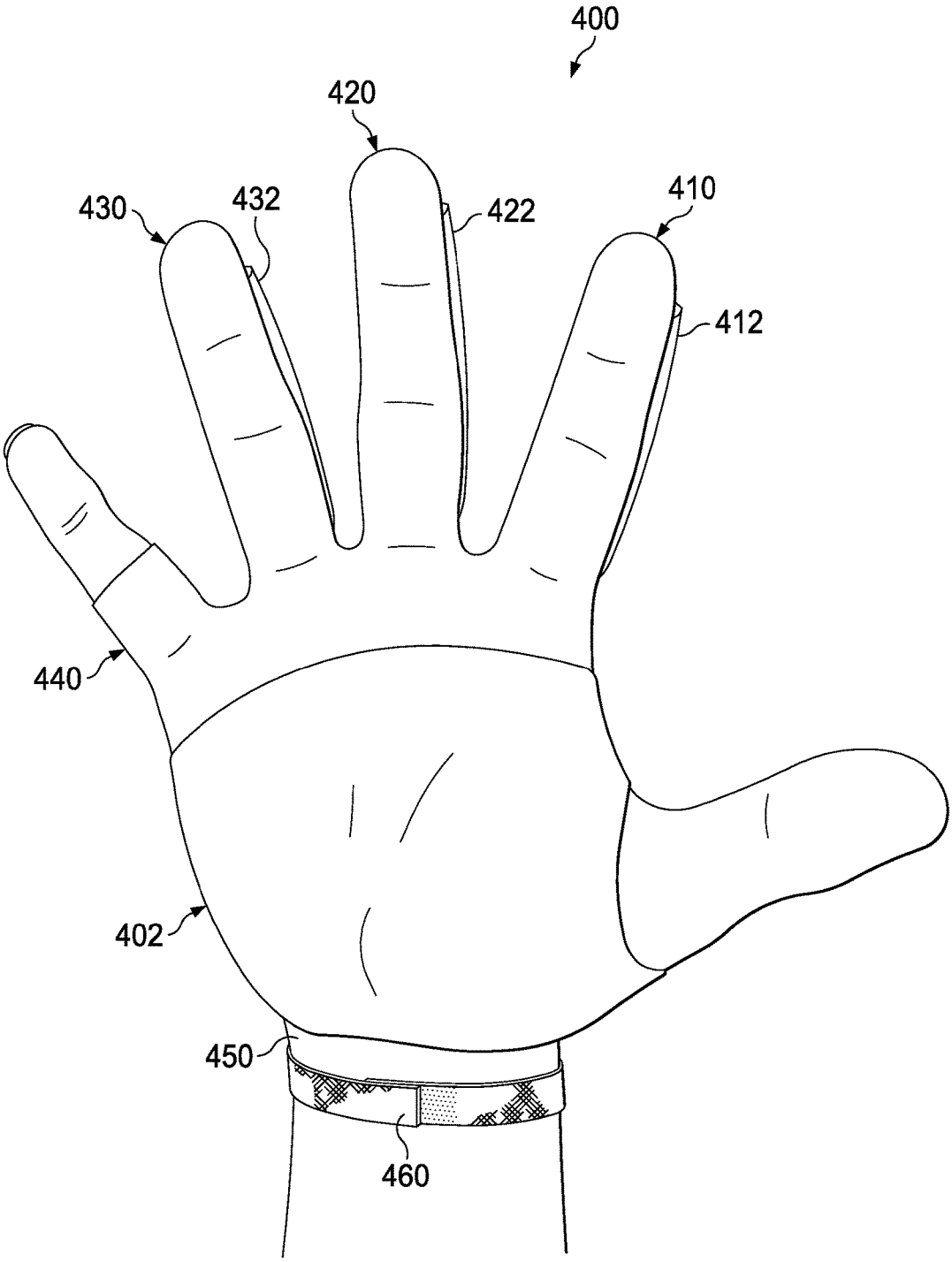
FIG. 4 illustrates a diagram of a protective glove constructed according to the principles of the disclosure.

FIG. 4 illustrates a diagram of a protective glove 400 constructed according to the principles of the disclosure. The protective glove 400 is a thermal protective glove constructed of a heat-resistant material, such as used with gloves to provide a thermal shield for thermal protection of a user's hand. An aramid fabric can be used in some embodiments. In some embodiments, the protective glove 400 may include an extra layer or layers of the heat resistant material for extra burn protection. For example, the protective glove 400 may include double thermal protection in a palm 402 of the protective glove 400.

In some embodiments, portions of the protective glove 100 may be constructed of conventional materials that are used for various types of gloves. Multiple types of materials may be used. Portions of the protective glove 400 may include a chemical resistant material that is configured to provide protection against chemicals used on a client's hair. The protective glove 400 may include multiple layers of material. For example, the protective glove 400 may include an inner layer, such as for padding, and an outer layer, such as for chemical protection. The heat-resistant material may be a third layer that provides a thermal shield to protect against hot hair.

Whether the whole glove or only at designated portions thereof, the heat-resistant material protects the hand from heat while working with hair. For example, during a straightening process, the hair can become sufficiently hot due to flat ironing to burn the skin of a hairstylist's hand. Designated portions for thermal protection can include an inner section of the fingers and along the web between fingers.

In FIG. 4, the protective glove 400 is presented on a right hand. The protective glove 400, however, may also be worn on a left hand. As such, the protective glove 400 may not be hand-specific but can be worn on either a right hand or a left hand. The protective glove 400 includes a first finger 410, a second finger 420, a third finger 430, a fourth finger 440, and a wrist portion 450. Double thermal protection may correspond to the palm 402 of the protective glove 400 and to a back portion (not visible in FIG. 4) of the protective glove 400 since the protective glove 400 can be used on either hand.

The first to fourth fingers 410 to 440, are constructed to fit over fingers of the hand of, for example, a hairstylist. In the illustrated embodiment, the first finger 410 fits over an index finger, the second finger 420 fits over a middle finger, the third finger 430 over a ring finger, and the fourth finger 440 over a pinky. In FIG. 4, the fourth finger 440 only partially covers a pinky finger. This allows a hairstylist to use their pinky to work with a client's hair. In other embodiments, the fourth finger 440 can fully cover the pinky.

The first, second and third fingers 410-430 include mounting sleeves 412, 422, 432 that are constructed to receive and secure hair styling devices, such as the comb 100 disclosed herein. The mounting sleeves 412, 422, 432, have a width and length that correspond to an attacher of styling devices, such as the attacher 150. For example, the free end 154 of the attacher 150 of the comb 100 can be slid into one of the mounting sleeves 412, 422, 432, in the direction from the tip of a finger. The mounting sleeves 412, 422, 432, include a stiffener (not visible) for rigidity and support of attached devices. The stiffener can be a piece of plastic that is sewn between two layers of the mounting sleeves 412, 422, 432. The gap 160 of the comb 100 can be sized to correspond to the thickness of the mounting sleeves 412, 422, 432, including the stiffener, to secure the comb 100 in place when slid into one of the mounting sleeves 412, 422, 432. In one embodiment, the mounting sleeves 412, 422, 432, are two inches or approximately two inches in length and have a width of half an inch or approximately half an inch. The mounting sleeves 412, 422, 432, can be sewn onto the fingers of the protective glove 400 and can also be constructed of the heat resistant material.

The wrist portion 450 provides an opening to place the protective glove 400 on the hand. In FIG. 4, the protective glove 400 includes a fastener 460 located at the wrist portion 450. The fastener 460 may include Velcro, a snap, a zipper, a button or other type of fastening devices that may be used to secure a glove on a hand. In some embodiments, the protective glove 400 may not include a fastener. As such, the shape thereof, for example, may be relied upon to keep the protective glove 400 on the hand. Additionally, in some embodiments, the fastener 460 may be located at a different location on the protective glove 400.

Those skilled in the art to which this application relates will appreciate that other and further additions, deletions, substitutions and modifications may be made to the described embodiments. Additionally, the hairstylists and clients referred to in this application are not restricted to professional hairstylists and paying clients.

What is claimed is:

1. A comb system comprising:

a glove having a palm covering portion and at least three finger covering sleeves;

one or more of the at least three finger covering sleeves each have a mounting sleeve providing a slot wherein the mounting sleeves are disposed along lateral side portions of the respective finger covering sleeves;

at least one comb comprising:

a base having a right side, a left side, a top side and a bottom side, where the top and bottom sides extend between the right and left sides to define a length of the base;

a longitudinal row of teeth extending along the length of the base on said top side;

an arch shaped curved structure attached to said bottom side of said base and extending downwardly away from said bottom side and said longitudinal row of teeth;

and an attacher having a coupling end and an extension, the coupling end being connected to a bottom side of said curved structure and to the left side of said base, the extension protruding longitudinally from the coupling end toward the right side such that a gap exists between the extension and the bottom side of the curved structure along the length of the extension;

wherein a cross section of the attacher in a direction perpendicular to the longitudinal length of the base has a curved shape defined by an arched central portion and flattened laterally extending end portions protruding from opposing ends of the arched central portion and the attacher is removably coupled to one of the mounting sleeves of the finger covering sleeves of the glove by sliding the extension into the slot of the one of the mounting sleeves, wherein the curved structure has flared ends which extend laterally outwardly past the flattened end portions of the attacher such that the curved structure covers the lateral side portions of the respective finger covering sleeve.

2. The comb as recited in claim 1 further comprising an appendicle coupled to an end of said base.

3. The comb as recited in claim 2 wherein said appendicle includes a pick.

4. The comb as recited in claim 3 wherein said pick is aligned with said longitudinal row of teeth and is tapered on one side.

5. The comb as recited in claim 2 wherein said appendicle includes a pick aligned with said row of teeth, wherein said pick has a tapered side located opposite said row of teeth.

6. The comb as recited in claim 1 wherein said attacher comprises a tapered free end.

7. The comb as recited in claim 1 wherein said row of teeth has teeth of different heights.

8. The comb as recited in claim 1 wherein heights of teeth of said row of teeth linearly increase from said right and left sides of the base.

9. The comb as recited in claim 2, wherein an end of the extension of said attacher is tongue-shaped.

10. The comb as recited in claim 1, wherein a length of said comb is less than three and a quarter inches and a greatest height of a tooth of said longitudinal row of teeth is less than one half of an inch.

11. The comb system according to claim 1, wherein at least one of said finger covering sleeves and said palm covering portion are constructed of a heat resistant material.

12. The comb system as recited in claim 11 further comprising a thumb covering portion extending from said palm covering portion, the thumb covering portion constructed of said heat resistant material.

13. The comb system as recited in claim 11 having at least one additional finger covering sleeve and at least one half finger covering sleeve, each constructed of said heat resistant material.

* * * * *